United States Patent [19]

Rosero

[11] 4,147,352

[45] Apr. 3, 1979

[54] ROTATABLE EJECTION CONTAINER GAME WITH RANDOM DISTRIBUTION

[76] Inventor: Jaime P. Rosero, 269 S. Lafayette Pk. Pl., Los Angeles, Calif. 90057

[21] Appl. No.: 802,151

[22] Filed: May 31, 1977

[51] Int. Cl.[2] ..... A63F 7/02; A63F 7/06

[52] U.S. Cl. ..... 273/93 R; 124/36; 273/119 R; 273/129 HA; 273/138 R; 273/DIG. 26

[58] Field of Search ..... 273/119 R, 138 R, 129 HA, 273/93 R; 124/36

[56] References Cited

U.S. PATENT DOCUMENTS

| | | | |
|---|---|---|---|
| 449,140 | 3/1891 | Scott et al. | 273/119 R |
| 1,037,877 | 9/1912 | Doerr | 273/138 R |
| 1,216,333 | 2/1917 | Lowther | 273/125 R |
| 1,531,455 | 3/1925 | Russell | 273/105 R |
| 1,547,313 | 7/1925 | Foster | 273/93 R |
| 2,303,017 | 11/1942 | Brown et al. | 124/36 |
| 2,436,816 | 3/1948 | Meyer | 273/93 R |
| 3,599,978 | 8/1971 | Sondergaard | 273/138 R |
| 3,679,208 | 7/1972 | Carrano, Jr. et al. | 273/138 R |

FOREIGN PATENT DOCUMENTS

| | | | |
|---|---|---|---|
| 405860 | 2/1934 | United Kingdom | 273/121 R |

*Primary Examiner*—Richard C. Pinkham
*Assistant Examiner*—Lawrence E. Anderson
*Attorney, Agent, or Firm*—C. Bruce Hamburg

[57] ABSTRACT

Apparatus suitable for use as a game or as a device for demonstrating the laws of probability comprises a container, apparatus for ejecting a ball into the container, structure generally closing the bottom of the container but provided with a plurality of openings each of diameter greater than the diameter of the ball, receiving apparatus for receiving a ball passing through any one of the openings, structure dividing the receiving means into a plurality of zones corresponding in number to the plurality of openings and respective structure for conducting a ball passing through a respective one of the openings to a respective one of the zones.

2 Claims, 4 Drawing Figures

ROTATABLE EJECTION CONTAINER GAME WITH RANDOM DISTRIBUTION

BACKGROUND OF THE INVENTION

This invention relates to an amusement or educational apparatus based on the laws of probability. More particularly, this invention relates to an apparatus suitable for use as a game or as a means for demonstrating the laws of probability.

There is a continuing demand for novel apparatuses for randomly assigning points or other values to players engaged in a game or for demonstrating the laws of probability.

It is an object of the invention to provide such an apparatus which is highly novel, reasonable in cost and highly appealing.

Other objects and advantages of the invention will be apparent from the following description of the invention.

SUMMARY OF THE INVENTION

According to the invention, there is provided apparatus suitable for use as a game or as a means for demonstrating the laws of probability comprising a container, means for ejecting a ball into the container, means generally closing the bottom of the container but provided with a plurality of openings each of diameter greater than the diameter of the ball, receiving means for receiving a ball passing through any of the openings, means dividing the receiving means into a plurality of zones corresponding in number to the plurality of openings and respective means for conducting a ball passing through a respective one of the openings to a respective one of the zones.

DETAILED DESCRIPTION OF THE PREFERRED EMBODIMENT

Figure 1:
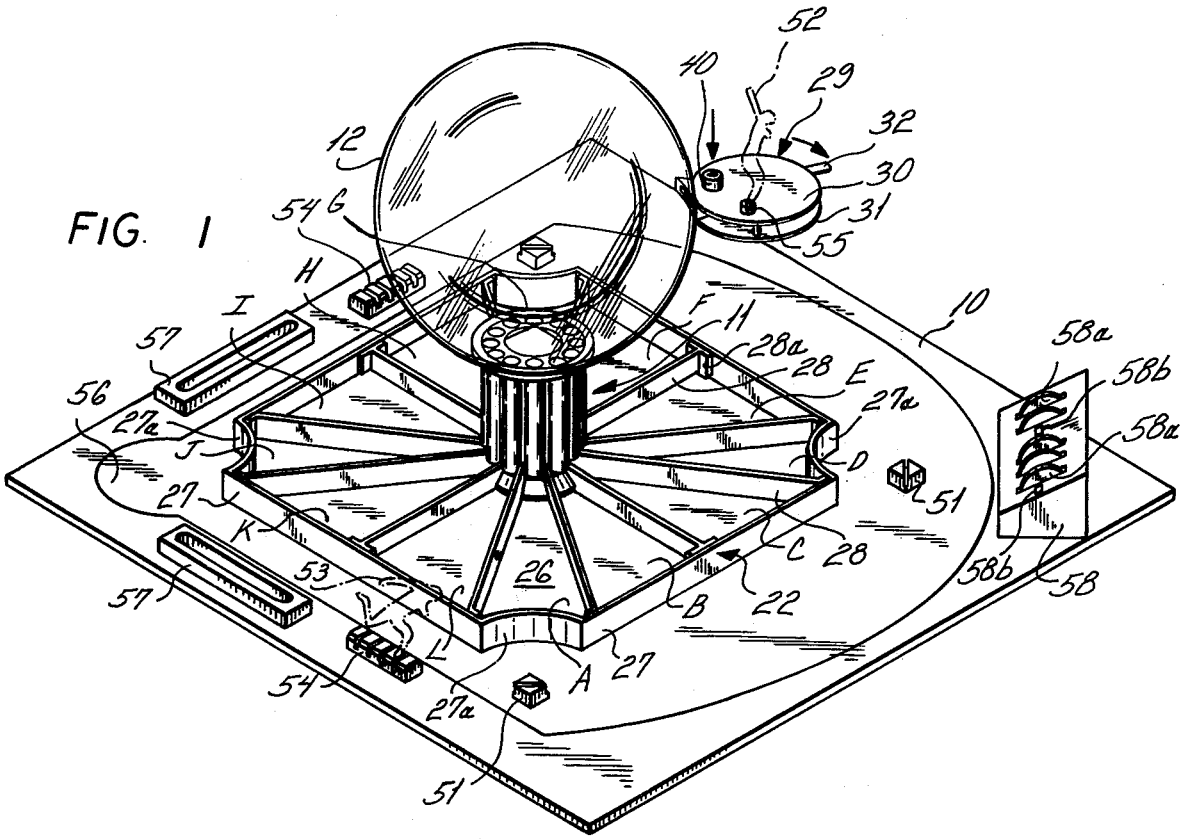
FIG. 1 is an isometric view of a game according to the invention.
Figure 2:
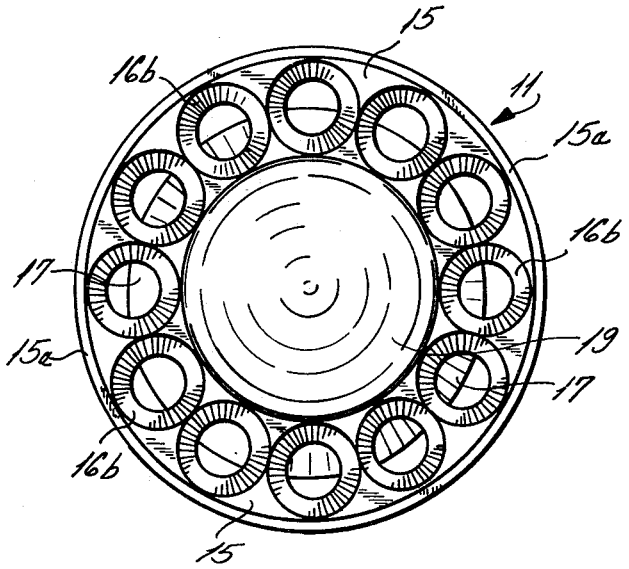
FIG. 2 is a plan view of a part of the game of FIG. 1.
Figure 3:
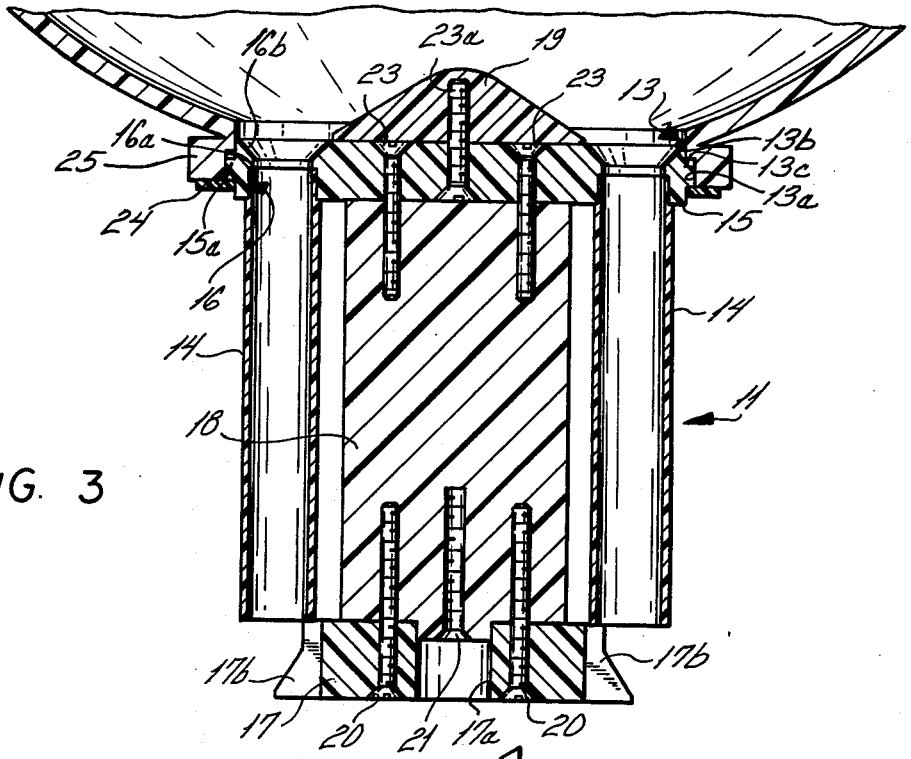
FIG. 3 is an axial cross section of a part of the game of FIG. 1.

With reference to FIG. 1, it is seen that the game is provided with a base in the form of a board 10. Mounted at the center of the board 10 is a pedestal assembly 11 (FIGS. 1–3). Supported on the pedestal assembly 11 is a transparent generally spherical container 12 having a downwardly directed circular mouth 13.

The pedestal assembly 11 supports twelve plastic tubes 14 of circular cross section equidistantly spaced from each other in a circular array concentrically about the axis of symmetry of the pedestal assembly 11 (FIGS. 2, 3). To this end, the pedestal assembly 11 includes a disc 15 which is generally similar in appearance to a telephone dial but has twelve circular openings 16 in the lower face thereof in the same arrangement as the tubes 14 and which receive the upper ends of the tubes 14. An annular lip 16*a* is formed inside the opening 16. The part 16*b* of the opening 16 which opens onto the upper face of the disc 16 is of the same diameter as the lip 16*a* at its lower extremity, which diameter is smaller than the external diameter of the tubes 14, and flares outwardly to a diameter at the upper face of the disc 16 greater than the external diameter of the tubes 14. Since the lip 16*a* is of smaller diameter than the external diameter of a tube 14, the tube 14 can abut against the lower face of the lip 16*a* but cannot pass beyond that point.

The pedestal assembly 11 also includes a base 17 in the form of a disc having a central opening 17*a*, a cylindrical column 18 and a hub 19 in the form of a cone having a rounded apex. The column 18 is concentrically mounted on the base 17 by means of four screws 20 each offset from the next by 90° received in holes passing through the base 17 and threaded holes machined in the column 18. The column 18 is mounted on the board 10 by means of a screw which passes through a hole in the center of the board and into an axial threaded hole 21 in the column 18. A hole is also provided in the center of a tray 22, which tray will be described in detail, the tray 22 resting on the board 10, the pedestal base 17 resting on the tray 22 and the aforementioned screw passing through the hole in the board 10 also passing through the hole in the tray 22 before being screwed into the threaded hole 21 whereby the same screw holds the tray 22 as well as the pedestal assembly 11 onto the board 10. The disc 15 is concentrically connected to the column 18 by means of four screws 23 each offset from the next by 90° passing holes in the disc 15 and being screwed into threaded holes in the column 18. The hub 19 is connected to the disc 15 by means of a screw 23*a* passing through a hole in the center of the disc 15 and being screwed into a threaded hole in the center of the hub 19. The lower edges of the tubes 14 rest on the upper surface of the disc 17.

The mouth 13 of the container 12 has a wider outer portion 13*a* and a narrower inner portion 13*b* the border between which is defined by a horizontal annular ledge 13*c*. The disc 15 has an annular lip 15*a* formed on the periphery thereof, the diameter of the lip 15*a* being greater than the diameter of the mouth portion 13*b* and slightly smaller than the diameter of the mouth portion 13*a*, whereby the disc 15, along with the hub 19 of the pedestal assembly 11, are received into the mouth 13 with the hub 19 extending into the interior of the container 12 but the pedestal assembly 11 will not fall into the capacitor 12 if the assembly of the pedestal assembly 11 and the container 12 is turned upside down, because, in that case, the lip 15*a* will abut against the annular ledge 13*c*. A flat circular ring 24 of smaller internal diameter than the diameter of the lip 15*a* but of slightly larger diameter than the rest of the disc 15 is mounted by means of very small screws (not shown) on a flange 25 surrounding the mouth 13 of the container 12. Consequently, if one should want to lift the game by means of the container 12, the container 12 will not be lifted off the pedestal assembly 11.

The tray 22 has a base 26 which rests on the board 10 and has side walls 27 in a generally square configuration with, however, for decorative purposes, portions 27*a* in the form of inwardly curved arches in the place of corners. The base 26 of the tray 22 is divided into a plurality of zones, A to L, by means of the walls 27 in combination with radially extending partitions 28 and the pedestal base 17. The partitions 28 are held in place at their outer ends by means of flanges 28*a* connecting the partitions 28 to the walls 27 and at their inner ends by means of radial slots 17*b* formed through the pedestal base 17 and in which the inner ends of the partitions 28 are received.

Figure 4:
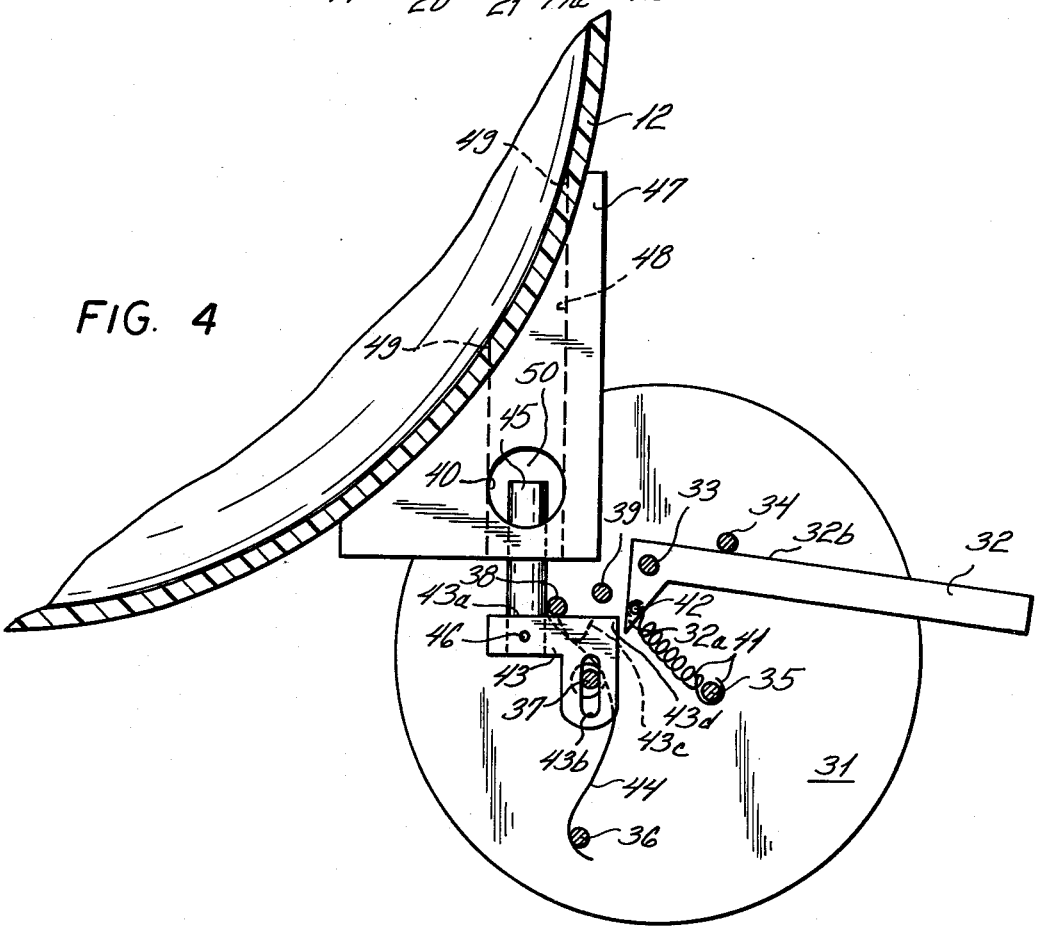
FIG. 4 is a plan view, partly in section, of a portion of the game of FIG. 1 with a circular cover plate removed.

Mounted on the container 12 is an ejection mechanism 29 for ejecting balls, one at a time into the container 12 approximately tangentially. The ejection mechanism 29 is of a construction which, in itself, is conventional but which, nevertheless, is illustrated generally in FIG. 1 and in detail in FIG. 4. The mechanism 29 is generally contained between upper and lower circular plates 30 and 31 and is actuated by pushing a lever 32 in the direction of the arrow adjacent thereto in FIG. 1. Pins 33 to 39 connect the plates 30 and 31 to each other also perform other functions as will hereafter be described.

A small ball, generally like a small marble or any other small sphere, is placed into a tubular loading chamber 40, as shown by the downwardly directed arrow adjacent thereto in FIG. 1, which passes through an opening in the upper plate 30. The lever 32 is pivotally mounted by means of the pin 33. A helical return spring 41 is connected at one end to the pin 35 by means of a horizontal loop formed at that end of the spring 41 and is connected at the other end to the actuating end 32*a* of the lever 32 by means of a small rivet 42. The spring 41 rotates the lever counterclockwise, as viewed in FIG. 4 until the edge 32*b* of the lever 32 rests against the pin 34, which serves as a stop. A second lever 43 is pivotally mounted by means of the pin 37. A spring 44 is connected to the lever 43/pin 37 assembly, a looped formed therein passing around the pin 37, and the spring 44 is stressed by means of one end thereof abutting against the pin 36 and the other end thereof abutting against a surface 43*c* formed on the lever 43 for this purpose. The spring 44, which functions as a return spring, rotates the lever 43 in a clockwise direction, as viewed in FIG. 4, so that the edge 43*a* of the lever 43 abuts against the pin 38, which functions as a stop. A hammer 45 is pivotally connected to the lever 43 by means of a pin 46. The ejection mechanism 29 also includes a mounting block 47 which is connected to the walls of the container 12 by means of screws (not shown). Through the block 47 is formed a tubular ejection passage 48 which communicates with the interior of the container 12 by means of an opening 49 formed through the spherical wall of the container 12. The hammer 45 is reciprocably received in the other end of the passage 48. The tubular loading chamber 40 intersects at right angles and communicates with the passages 48. When the mechanism 29 is inactive, the free end of the hammer 45 extends into the aforementioned intersection, the intersection constituting an ejection chamber 50.

When the lever 32 is pushed in the clockwise direction (FIG. 4), the actuating portion 32*a* of the lever 32 engages the corner 43*d* of the lever 43, thereby rotating the lever 43 somewhat counterclockwise, sufficiently to cause the lever 43 to retract the hammer 45 out of the ejection chamber 50, permitting a ball which has been loaded into the loading chamber 40 to drop into the ejection chamber 50, and then the actuating portion 32*a* disengages from the corner 43*d*, whereupon the spring 44 rapidly rotates the lever 43 clockwise, causing the hammer 45 to reenter the ejection chamber 50 and sharply strike the ball therein, whereby the ball is ejected through the passage 48 and the opening 49 into the container 12. The pin 39 serves as a stop, the actuating portion 32*a* of the lever 32 coming to abut against the pin 39, whereby the clockwise rotation of the lever 32 is limited. The pin 37 passes through a slot 43*b* in the lever 43. The lever is urged upward in FIG. 4 by the abutment of an end of the spring 44 against the surface 43*c*. However, when the lever 32 is released by the user after a ball has been ejected, the force of the return movement of the lever 32 imparted by the spring 41 is sufficient to cause the tip of the lever portion 32*a* to slide along the lever edge 43*a*, urging the lever 43 downward relative to the pin 37, this movement being permitted by the slot 43*b*, until the aforementioned tip clears the lever corner 43*a*, whereupon the lever 43 shifts again upward and the entire mechanism has returned to the rest position illustrated in FIG. 4.

When a ball is ejected into the container 12, it contacts the walls of the container 12 and, at the same time, while rolling and bouncing about in the container 12, gravitates toward the hub 19 and the disc 15. Since the walls of the container 12 and the surface of the hub 19 slope downward toward the disc 15, the ball is guided onto the disc 15 as the ball gravitates downwardly. The spacings between the openings 16*b* in the upper face of the disc 15 are so small that it is essentially impossible that the ball will come to a rest on a portion of the disc 15 defining such a spacing. Rather, the ball will drop into one of the openings 16*b*, gravitate downwardly through the particular tube 14 communicating with that opening and into the particular zone A to L of the tray base 26 onto which the particular tube 14 discharges. Each of the zones A to L may be marked with any indicia appropriate to a particular game. For example, each zone may be assigned a certain number of "points" and two or more players may keep score as to who scores the most points. How the structure of the apparatus of the present invention is used for entertainment or educational purposes, the latter such as in demonstrating the laws of probability, depends upon the imagination of the user and any application of the apparatus of the present invention is considered part of the invention.

As illustrated in FIG. 1, by way of example, the apparatus of the invention is applied as a baseball game. Imprinted on the board 10 is the general configuration of a baseball diamond. First, second and third bases are in the form of respective slotted blocks 51. Each player is provided with a flat rigid plastic batter figure 52, one of which is shown in phantom in FIG. 1, and three flat rigid plastic baserunner FIGS. 53, one of which is also shown in phantom in FIG. 1. Between home and first base and between home and third base, more or less in the locations of team dugouts, are provided respective four-slotted blocks 54 for holding the batter and three baserunners with which each player is provided. Mounted on the upper plate 30 of the ejection mechanism 29 is another slotted block 55. When a player is "at bat," he mounts his batter in the block 55, by means of the slot therein, in order to add to the illusion of a baseball game. A home plate may be imprinted on or adhered to the plate 30 in an appropriate position alongside the block 55. There are sufficient clearances between the portions of the disc 15 fitting into the mouth 13 of the container 12 and the portions of the mouth 13 into which the aforementioned portions of the disc 15 fit that the container 12 may be readily manually rotated relative to the pedestal assembly 11. If desired, the players may always rotationally orient the container 12 relative to the pedestal assembly 11 so that the batter 52 and any adjacent homeplate indicia are directly over the area 56 of the baseball diamond imprinted on the board 10 corresponding to where homeplate would be located on an actual baseball diamond. However, it will usually be particularly convenient that the container 12 be turned to some different rotational orientation, as illustrated for example in FIG. 1, to be convenient to the seating location of the player whose "team" is "at bat".

The zones A to L are marked on the base 26 of the tray 22 with indicia suitable to baseball, such as "ball," "strike," "homerun," "single," and so forth. Normal baseball scoring procedures are followed and the baserunners 53 are mounted in respective slotted blocks 51 to keep track of the imaginary progress of baserunners on the diamond as the batters "get on base" depending on which zone A to L an ejected ball gravitates into.

Two troughs 57 may be mounted on the board 10 in a respective one of which each player may retain a supply of balls to be ejected by the ejector mechanism 29 when it is his turn "at bat". There may also be mounted on the board 10 a simple counter device 58 for score keeping purposes. For example, as illustrated, the counter 58 may be provided with thumb operated discs 58*a* which rotate digits into view in respective windows 58*b* associated therewith.

The spherical container 12, tubes 14, tray 22 and partitions 28 are preferably fabricated of transparent plastic so that the motion of the ejected balls may be readily observed adding to the excitement of using the device. Further visual interest may be added, for example, by fabricating the respective tubes 14 of different colored transparent plastics. Moreover, decoration in the configuration of the seams of a baseball may be applied to the surface of the spherical container 12 to increase the players' mental association with baseball and consequent enjoyment of the game.

While the invention has been particularly described by reference to a specific embodiment, it is to be understood that such description is intended to illustrate the invention rather than to limit the scope of the invention as defined by the hereto appended claims.

What I claim is:

1. An apparatus suitable for use as a game or as a means for demonstrating the laws of probability comprising an at least partially spherical container, means fixed to the container for ejecting a ball into the container at the portion of the container having the greatest diameter such that the ball may roll in a random unrestricted manner on the interior wall of the container, means for rotating the container 360° thereby to permit one to operate the ejecting means from any position around the game without moving, means generally closing the bottom of the container but provided with a plurality of openings each of diameter greater than the diameter of the ball, receiving means for receiving a ball passing through any one of said openings, means dividing said receiving means into a plurality of zones corresponding in number to the plurality of openings and respective means for conducting a ball passing through a respective one of said openings to a respective one of said zones, the conducting means comprising a plurality of tubes of approximately the same diameter as the openings and corresponding in number to the plurality of openings, the ejecting means comprising a pair of superimposed substantially horizontal plates with a space provided therebetween and an ejection mechanism housed between the plates, the ejection mechanism comprising first and second levers, one end of the first lever being free for engagement by the hand of an operator of the apparatus, the second lever being of an angular configuration including two legs merging at a corner, the other end of the first lever being so closely spaced from said corner that the path of movement thereof intercepts said corner of the second lever, a substantially horizontal ejection chamber for carrying a ball to be ejected into the container, a substantially vertical loading chamber formed through the upper of said plates above said ejection chamber so that the ball will be fed by gravity from said loading chamber into said ejection chamber, a hammer extending into the ejection chamber for striking the ball, means pivotally connecting one end of the hammer to a leg of the second lever and the other end of the hammer being free for striking the ball, the other leg of the second lever having a slot formed therein, a pin rigidly connected to the plates and slidably received in the slot, a first spring arranged to rotationally bias the second lever in the rotational direction which moves the hammer toward a ball in the chamber, a second spring arranged to rotationally bias the first lever in the rotational direction opposite the rotational biasing of the second lever, whereby manual actuation of the first lever actuates the second lever against the bias of said spring and subsequently releases said second lever thereby to cause the hammer first to substantially linearly partly retract from said ejection chamber thereby to permit the ball to drop from the loading chamber into the ejection chamber and then to follow the same path in reverse to strike and eject the ball.

2. An apparatus according to claim 1 for use as a baseball game, the apparatus further comprising a board supporting the container, a baseball diamond imprinted on the board, three slotted blocks fixed at three respective corners of the diamond representing first, second and third bases, base runner figures adapted to be supported by said slotted blocks, a slotted block fixed on the ejecting means, and a batter figure adapted to be supported by the slotted block on the ejecting means.

* * * * *

UNITED STATES PATENT AND TRADEMARK OFFICE

CERTIFICATE OF CORRECTION

PATENT NO. : 4,147,352

DATED : April 3, 1979

INVENTOR(S) : Jaime P. Rosero

It is certified that error appears in the above-identified patent and that said Letters Patent are hereby corrected as shown below:

Column 2, line 25, change "passing holes" to --passing through holes--;
line 43, change "capacitor 12" to --container 12--.

Column 3, line 9, change "other also" to --other and also--;
line 25, change "looped" to --loop--;
lines 44-45, change "passages 48" to --passage 48--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*